United States Patent [19]

Zuniga

[11] 4,451,113

[45] May 29, 1984

[54] MAGNETIC SAFETY RECEPTACLE AND PLUG

[75] Inventor: Michael A. Zuniga, Carmel, Calif.

[73] Assignee: Mid Coast Electronics, Monterey, Calif.

[21] Appl. No.: 404,643

[22] Filed: Aug. 2, 1982

[51] Int. Cl.[3] ..... H01R 11/30

[52] U.S. Cl. ..... 339/12 R

[58] Field of Search ..... 200/51.09; 339/12 R, 339/6

[56] References Cited

U.S. PATENT DOCUMENTS

| | | | |
|---|---|---|---|
| 2,298,313 | 10/1942 | Ross | 200/51.09 |
| 2,573,920 | 11/1951 | McLeod | 339/12 R |
| 3,521,216 | 7/1970 | Tolegian | 339/12 R |
| 3,868,160 | 2/1975 | Kersman | 339/12 R |

FOREIGN PATENT DOCUMENTS

| | | | |
|---|---|---|---|
| 1283003 | 7/1972 | United Kingdom | 200/51.09 |

*Primary Examiner*—Eugene F. Desmond

*Attorney, Agent, or Firm*—Paul L. Hickman

[57] ABSTRACT

A magnetically actuated safety receptacle and plug characterized by a receptacle having a first pair of electrical contacts extending through a support member, and an over-center drop-out member hinged to the support member and carrying a second pair of electrical contacts. When a magnetic plug is inserted into a recess provided in the front of the support member the drop-out member is magnetically attracted towards the support member so that the first pair of electrical contacts and the second pair of electrical contacts abut to provide power to the plug. The hinge attaching the drop-out member to the support member is articulated so that the contacts can wipe against each other to remove any oxide build up. An industrial version of this invention includes a gas tight enclosure surrounding the drop-out member and the interior contacts to prevent accidental ignition of combustible gases.

6 Claims, 7 Drawing Figures

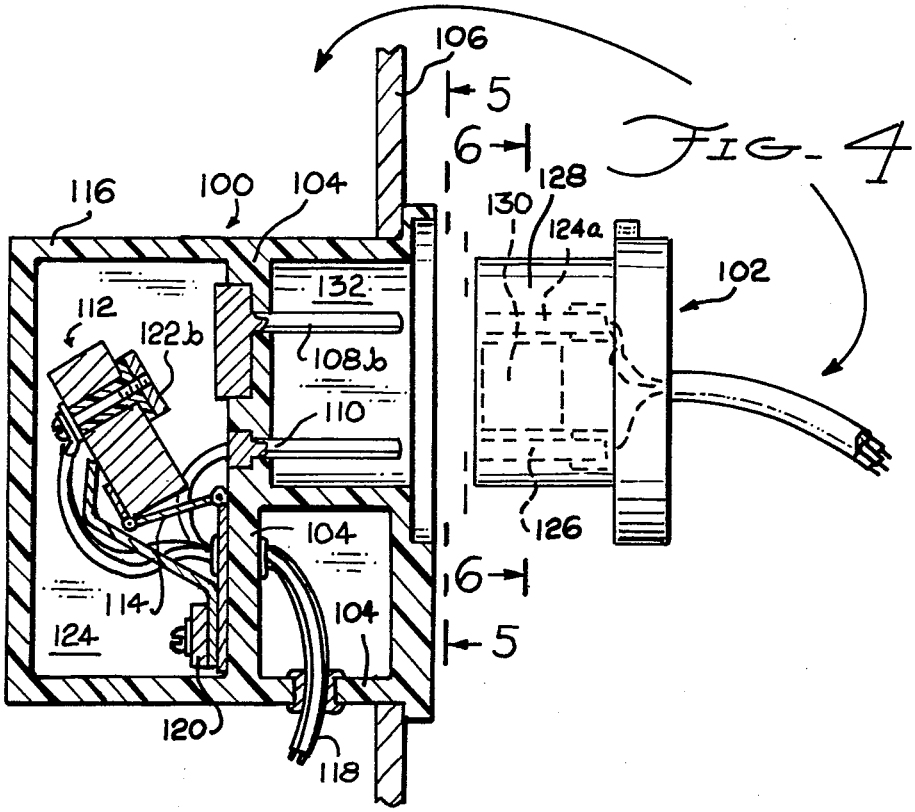
FIG. 4.
FIG. 5.
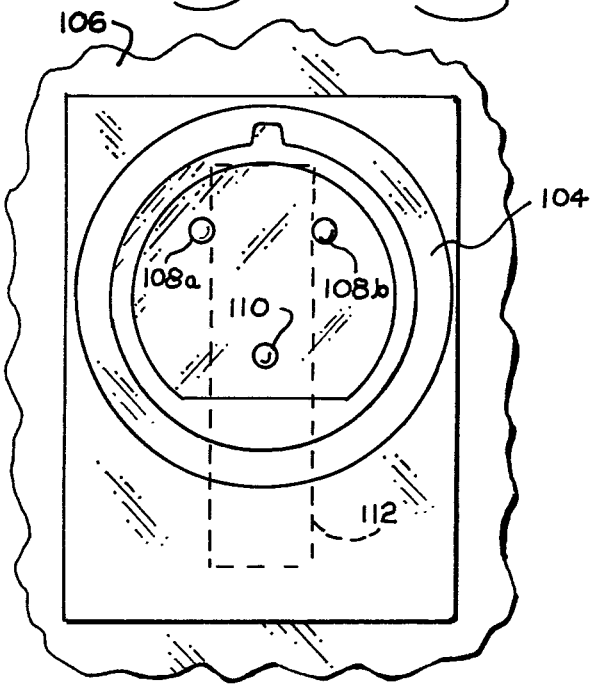
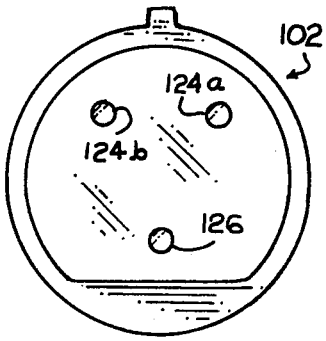
FIG. 6.

MAGNETIC SAFETY RECEPTACLE AND PLUG

BACKGROUND OF THE INVENTION

1. Field of the Invention

This invention relates generally to electrical connectors and more particularly to magnetically actuated electrical connectors.

2. Description of the Prior Art

There are a number of magnetically actuated receptacles found in prior art. For example, in U.S. Pat. No. 3,521,216 of Tolegian a device including a magnetic plug and a magnetic base-board receptacle is disclosed. The base-board receptacle includes magnetized, spring loaded contacts attracted to a magnetized plug. In U.S. Pat. No. 2,573,920 McLeod teaches a similar device including a magnetic plug and a base-board receptacle having a pair of magnetically actuated shorting bars.

All known magnetically actuated receptacles utilize springs or other resilient members to bias "hot" contacts away from exposed electrical contacts to prevent accidental shocks. The prior art devices, while simple in concept, require a fair number of co-acting elements. For example, Tolegian's device includes seven small springs and four moving members, each of which is subject to wear and eventual failure. Small springs and moving parts further can be become stuck within their guide channels should any moisture or gummy substance happen to be present.

A problem not addressed by the prior art is how to prevent oxidation of the electrical contacts of the receptacle. Just prior to closing, electrical contacts may produce a slight spark or electrical arc which can produce oxidation on the exposed surfaces. Oxidation of the contacts increases the resistance of the contacts and reduces the overall efficiency of the device.

A danger not addressed by the prior art is that of accidental ignition of combustible gasses by arcing contacts.

SUMMARY OF THE INVENTION

A major object of this invention is to provide a reliable and long lasting magnetically operated safety receptacle.

A further object of this invention is to provide a safety receptacle which does not rely upon spring biasing and which does not have any sliding members which could become stuck in their guide channels.

Another object of this invention is to provide a safety receptacle which reduces the oxide build-up on its electrical contacts.

A further object of this invention is to provide a safety magnetically operated receptacle which can prevent the accidental ignition of flammable gases.

Briefly, the invention includes a magnetically actuated receptacle attached to a wall or base-board and a magnetic plug engagable with the receptacle. The receptacle includes a support member attached to the wall, a first pair of electrical contacts extending though the support member, and an over-center drop-out member coupled to an interior surface of the support member by an articulated hinge. The drop-out member includes a second pair of electrical contacts adapted to abut the first electrical contact pair. When the magnetic plug is engaged with the receptacle the drop-out member moves from an open position to a closed position where the contacts are in abutment. The articulated hinge allows the drop-out member to pivot towards the first electrical contact pair and, to a limited extent, to slide vertically to break any oxide that may be forming on the contacts.

An industrial version of this device includes a gas tight enclosure which fully isolates the drop-out member and the interior contacts from the ambient environment. The first pair of electrical contacts extend through the support member and form male pins which engage female sockets in the magnetic plug. Since the final electrical contact will always be within the gas tight enclosure, this industrial version will not accidentally ignite flammable gases that may be present.

An advantage of this invention is that the drop-out member is gravitationally biased rather than biased by the springs taught by the prior art. This results in a simpler, more reliable magnetically operated receptacle.

Another advantage of this invention is that the problem of oxide build-up on the electrical contacts is minimized due to the wiping action of the first and second pair of electrical contacts.

Another advantage of this invention is that the drop-out carries two electrical contacts so that multiple ferromagnetic elements are not required in the receptacle assembly.

Yet another advantage of this invention is that the industrial model eliminates the risk of igniting any flammable gasses that may be present.

These and other objects and advantages of the present invention will no doubt become apparent upon a reading of the following descriptions and a study of the several figures of the drawing.

BRIEF DESCRIPTION OF THE DRAWING

FIG. 4 is a partially cross-sectioned elevational view illustrating an alternate embodiment of the present invention.

FIG. 5 is a view taken along line 5—5 of FIG. 1.

FIG. 6 is a view taken along line 6—6 of FIG. 4.

DETAILED DESCRIPTION OF THE PREFERRED EMBODIMENT(S)

Figure 2:
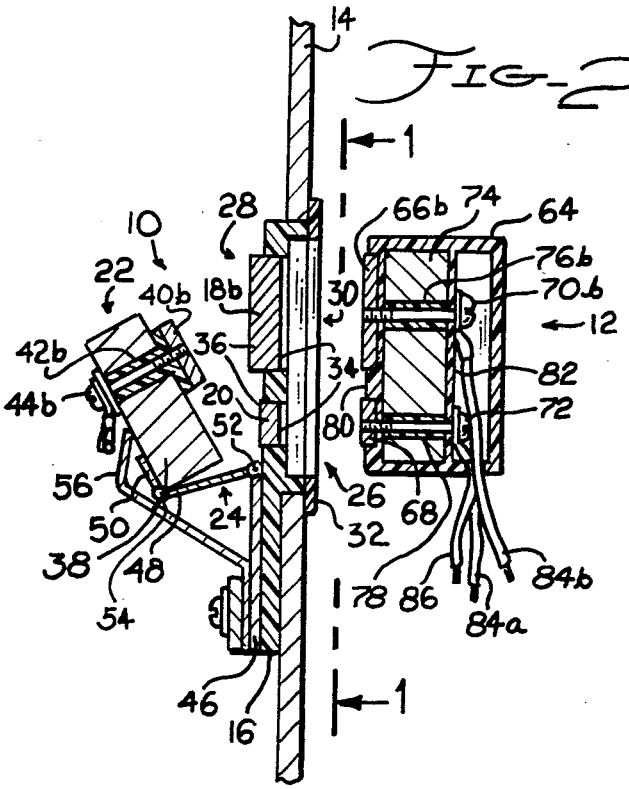
FIG. 2 is cross-sectional view taken along line 2—2 of FIG. 1.
Figure 1:
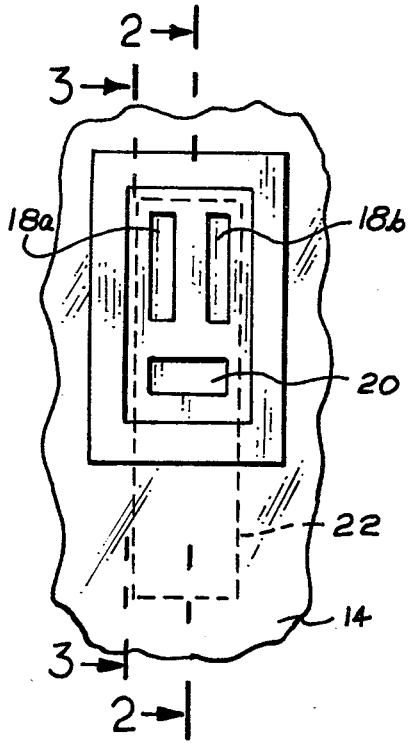
FIG. 1 is a front elevational view of the magnetic safety receptacle of the present invention.

Referring to FIGS. 1–3 and 3A, a magnetic safety receptacle plug in accordance with the invention includes a receptacle assembly 10 and a plug assembly 12. The receptacle assembly 10 is mounted on a wall or a base-board 14 and includes a base or support member 16, a first pair of electrical contacts 18A and 18B, a first ground contact 20, and an over-center drop-out member 22 coupled to support member 16 by an articulated hinge 24.

Support member 16 is mounted though base-board 14 and has exterior surfaces 26 and interior surfaces 28. The support member is flanged at 32 and includes a recess 30 receptive to the plug assembly 12. The first pair of electrical contacts 18A and 18B are embedded in the support member and have exterior surfaces 34 and interior surfaces 36. The support member can be made from any suitable material, but is preferably constructed from a thermoplastic material having a high resistivity.

First contact pair 18A and 18B and first ground contact 20 can be made from any suitable conductive material such as copper, brass, etcetera. As noted in FIG. 1, contacts 18A, 18B, and 20 are preferably elongated rectangular prisms positioned vertically (18A and 18B) and horizontally (20) with respect to the support member 16. Of course, the electrodes could have other configurations and be arranged in different patterns.

Figure 3:
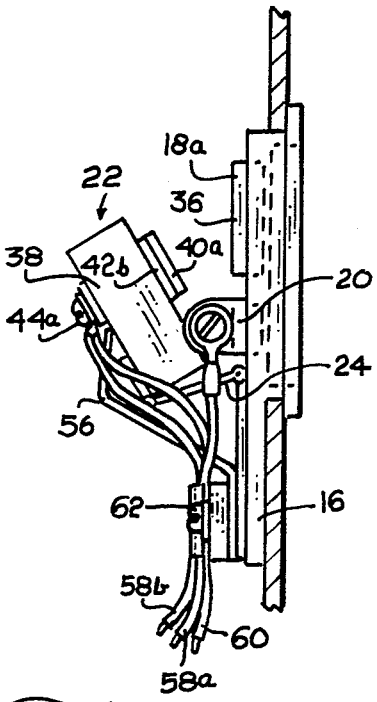
FIG. 3 is cross-sectional view taken along line 3—3 of FIG. 1.

The drop-out member 22 includes a main body portion 38 and a second pair of electrical contacts 40A and 40B. In FIGS. 2 and 3 it can be seen that contacts 40A and 40B are insulated from the main body portion 38 by insulating sleeves 42A and 42B. Bolts 44A and 44B are disposed though the insulating sleeves to attach the contacts to the main body portion.

The drop-out member must include some material having ferromagnetic properties. In this embodiment main body portion 38 is made from a ferromagnetic material such as an iron magnet, but in alternate embodiments the ferromagnetic materials may be attached to or embedded within a main body portion not possessing ferromagnetic properties itself.

Articulated hinge 24 includes three sections labeled 46, 48 and 50. A pivot 52 connects section 46 to section 48 and a pivot 54 connects section 48 to section 50. Section 46 is attached to support member 16 and section 50 is attached to main body portion 38 of drop-out member 22. As will be discussed subsequently, the articulated hinge permits the drop-out member to both pivot towards the first contact pair 18A and 18B, and an to move slightly vertically against the first contact pair.

A 'Z' shaped stop member 56 has one leg attached to support member 16 and another leg which can abut a rear surface of drop-out member 22 (see FIGS. 2 and 3). The stop member limits the over-center position of the drop-out member.

In FIG. 3 a number of lead wires 58A, 58B, and 60 are shown affixed to support member 16 by a clamp 62. Wires 58A and 58B lead to bolts 44A and 44B, respectively, and wire 60 leads to the first ground contact 20. Wire 60 is grounded and wires 58A and 58B are coupled into the household electrical circuits.

Plug assembly 12 includes an enclosure 64, a third pair of electrical contacts 66A (not shown) and 66B, and a second ground contact 68. Contacts 66A, 66B, and 68 are attached to main body portion by screw fasteners 78A (not shown), 70B and 72. The plug assembly also includes a material 74 having ferromagnetic properties. Again, ferromagnetic material 74 is preferably a soft iron magnet. Insulating sleeves 76A (not shown), 76B, 78, and insulating barriers 80 and 82 electrically isolate the contacts 66A, 66B, and 68 from ferromagnetic material 74. Lead wires 84A, 84B, and 86 are coupled to screws 70A, 70B, and 70C, respectively at one of their ends and to an appliance to be powered at their other ends.

The front end of enclosure 64 is configured to fit within recess 30 of the receptacle assembly. Electrodes 66A, 66B, and 68 are adapted to abut electrodes 18A, 18B, and 20, respectively, when the plug assembly is engaged with the receptacle assembly.

Figure 3A:
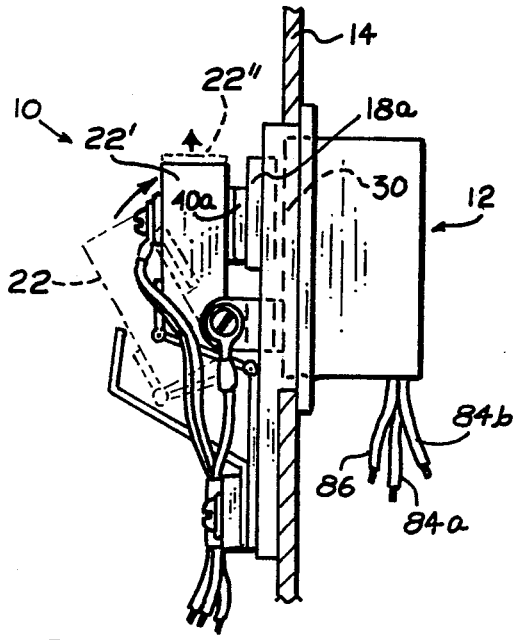
FIG. 3A is similar to the cross-section of FIG. 3 and illustrates the operation of the present device.

The operation of this invention will be discussed with particular reference to FIG. 3A. When the plug assembly 12 is engaged with recess 30 the drop-out member 22 (shown in phantom in FIG. 3A) will pivot to a semi-upright position 22' (shown in solid lines in FIG. 3A). The drop-out member will then slide vertically upward to a new position 22', as indicated in heavy broken lines at 22''.

Drop out member 22 is still in an over-center, unbalanced position in positions 22' and 22''. When magnetic plug is removed it will, under the influence of gravity, fall back to its open position 22. The drop-out member is rotated to and held in its substantially upright position by magnetic attraction between the ferromagnetic elements of the drop-out member and the plug assembly. At least one of the ferromagnetic members must be magnetized. Of course, the ferromagnetic members of both the plug assembly and the drop-out member are preferably magnetized in a complimentary manner to produce a strong magnetic attraction.

The ferromagnetic materials in the plug assembly 12 and the drop-out member 22 are arranged so that the slight upward wiping motion of contacts 40A and 40B against contacts 18A and 18B loosen and remove any oxide that may be building up. This insures good electrical contact between the internal contact members.

To summarize, before plug assembly 12 is engaged with the recess 30 of the receptacle assembly, drop-out member 22 is in its open position and contacts 18A and 18B are safely unpowered. When the plug assembly 12 is engaged with recess 30 of receptacle assembly 10, the ferromagnetic materials in the plug and the drop-out member attract each other and the drop-out member pivots first to the position shown 22' and then upwardly to the position indicated at 22''. With the drop-out member in this closed position the receptacle is powered and current can be drawn from wires 84A and 84B of the plug assembly.

Referring to FIGS. 4–6, an industrial version of the present invention includes a receptacle assembly 100 and a magnetic plug assembly 102. The receptacle assembly includes a support member 104 attached a baseboard 106, a first electrical contact pair 108A and 108B, a first ground contact 110, an over-center drop-out member 112 attached to support member 104 by an articulated hinge 114, and a gas tight enclosure 116 attached to the support member and totally isolating the drop-out member and the interior contacts from the ambient environment. The drop-out member includes a material having ferromagnetic properties.

As noted in FIGS. 4 and 5, contact pair 108A and 108B and first ground contact 110 extend away from the exterior surface of the support member 104 as elongated male pins. Wires 118 are fed through a sealed connector block 120 to connect a second pair of contacts 122A (not shown) and 122B of the drop-out member, and ground contact 110 to the industrial power circuits. A relatively inert gas 124 such as nitrogen can be used to pressurize the sealed volume within enclosure 116.

Plug 102 includes a third electrical contact pair 124A and 124B, and a second ground contact 126. Contact pair 124A and 124B and ground contact 126 are, in this embodiment, female sockets receptive male pins 108A, 108B, and 110, respectively. Within the plug body 128 is a ferromagnetic material 130. The forward portion of plug body 128 engages a recess 132 of support member 104.

In use, the female sockets 124A, 124B, and 126 are engaged with male pins 108A, 108B, and 110 and the forward portion of plug body 128 slides into recess 132 of the support member. The magnetic attraction between the plug assembly and the drop-out member is strong enough to pull the drop-out member to its substantially upright, closed position only when the plug body is fully engaged with recess 132. In this manner, the last electrical contact to be made will always be between the first electrical contact pair and the second electrical contact pair within gas-tight enclosure 116. Thus, there is no chance that flammable gasses might be ignited by the activation of the magnetic receptacle of this second embodiment.

While this invention has been described in terms of a few preferred embodiments, it is contemplated that persons reading the preceding descriptions and studying the drawing will realize various alterations, permutations and modifications thereof. It is therefore intended that the following appended claims be interpreted as including all such alterations, permutations and modifications as fall within the true spirit and scope of the present invention.

What is claimed is:

1. A safety receptacle and plug comprising:

a receptacle assembly including support means having an exterior surface and an interior surface, a first electrical contact pair extending through said support means and having exterior surfaces and interior surfaces, an over-center drop-out member coupled to said support means proximate said interior surface, said drop-out member including a second electrical contact pair adapted to abut the interior surfaces of said first electrical contact pair, and a first ferromagnetic member, where said drop-out member is movable between an open position and a closed position in contact with said first electrical contact pair; and a plug assembly including a plug body, a third electrical contact pair supported by said plug body and adapted to abut the exterior surfaces of said first electrical contact pair, and a second ferromagnetic member carried by said plug body;

whereby when said third electrical contact pair abuts said first electrical contact pair magnetic attraction between said first ferromagnetic member and said second ferromagnetic member causes said drop-out member to move to said closed position.

2. A safety receptacle and plug of claim 1 further comprising a first ground contact extending through said support means and presenting an exterior surface, and a second ground contact supported by said plug body and adapted to abut said exterior surface of said first ground contact.

3. A safety receptacle and plug of claim 1 wherein said drop-out member is coupled to said support means by an articulated hinge which permits pivotal rotation towards said interior surface of said support means and a linear wiping motion between said first electrical contact pair and said second electrical contact pair.

4. A safety receptacle and plug of claim 1 further comprising a stop member attached to said support means for limiting the over-center position of said drop-out member.

5. A safety receptacle and plug of claim 2 further comprising a gas tight enclosure attached to said interior surface of said support means to isolate said interior surface of said first electrical contact pair and said drop-out from the ambient environment.

6. A safety receptacle and plug of claim 5 wherein said exterior surfaces said first electrical contact pair and said first ground contact include outwardly extending male pins, and wherein said third electrical contact pair and said second ground contact include female sockets receptive to said pins.

* * * * *